US005622922A

United States Patent [19]

Clarke et al.

[11] Patent Number: 5,622,922

[45] Date of Patent: Apr. 22, 1997

[54] METHOD OF SOLUBILIZING A BENZOTRIAZOLE WITH A THIADIAZOLE

[75] Inventors: Dean B. Clarke, Neshanic Station; Dale R. Carroll, Rahway, both of N.J.

[73] Assignee: Exxon Chemical Patents Inc., Linden, N.J.

[21] Appl. No.: 579,530

[22] Filed: Dec. 27, 1995

[51] Int. Cl.[6] ..... C10M 133/38

[52] U.S. Cl. ..... 508/272; 508/273; 508/274; 508/280; 548/130; 548/136; 548/142; 548/269.4

[58] Field of Search ..... 548/130, 136, 548/142, 269.4; 508/272, 273, 274, 280, 296

[56] References Cited

U.S. PATENT DOCUMENTS

| | | | |
|---|---|---|---|
| 4,264,653 | 4/1981 | Lochel, Jr. | 427/318 |
| 4,315,889 | 2/1982 | McChesney et al. | 422/7 |
| 4,871,465 | 10/1989 | Hutchison . | |
| 4,948,523 | 8/1990 | Hutchison et al. . | |
| 5,035,720 | 7/1991 | Weers | 44/343 |
| 5,185,090 | 2/1993 | Ryer et al. . | |
| 5,225,093 | 7/1993 | Campbell et al. . | |
| 5,342,531 | 8/1994 | Walters et al. . | |
| 5,453,210 | 9/1995 | Bardasz et al. . | |
| 5,490,946 | 2/1996 | Beltzer et al. | 508/272 |

FOREIGN PATENT DOCUMENTS

0618284A1 10/1994 European Pat. Off. .

OTHER PUBLICATIONS

"The Effect of Using Sulphurous Antiscuffing Additives in Conjunction With Copper Corrosion Inhibitors in Lburicating Oils" Soviet Engineering Research, Vestnik Mashinostrocniya, vol. 62, Issue 7, 1982, pp. 39–41.

*Primary Examiner*—Prince Willis, Jr.
*Assistant Examiner*—Cephia D. Toomer
*Attorney, Agent, or Firm*—John W. Ditsler

[57] ABSTRACT

A homogenous product is formed by heating at a temperature in the range of from 50° to 150° C. a mixture of a benzotriazole and a 2,5-dihydrocarbyldithio-1,3,4-thiadiazole.

10 Claims, No Drawings

METHOD OF SOLUBILIZING A BENZOTRIAZOLE WITH A THIADIAZOLE

BACKGROUND OF THE INVENTION

This invention relates to a method of solubilizing a benzotriazole using one or more thiadiazoles, particularly a 2,5-dihydrocarbyldithio-1,3,4-thiadiazole.

Benzotriazole and its derivatives (e.g. tolyltriazole) are known to be corrosion inhibitors in lubricating oils (see for example U.S. Pat. No. 4,197,210). However, one problem associated with using a benzotriazole in lubricating compositions is that the benzotriazole is a solid at room temperature, and hence, incompatible with the lubricating composition and any oil-soluble additives present therein. Accordingly, it would be desirable to have available a simple yet convenient method of solubilizing (or pre-dissolving) the benzotriazole so that it can be easily added to and used in a lubricating composition.

Various methods have been suggested for solubilizing benzotriazole and its derivatives. For example, a long chain succinimide dispersant has been used as a solubilizing agent (see Canadian Patent 1,163,998 and U.S. Pat. No. 4,855,074), as have oil-soluble alcohols such as lauryl alcohol and oleyl alcohol (see Japanese application 52024202), as have various amines (see Canadian Patent 1,163,998). However, applicants are not aware of any publications disclosing the particular method and ingredients described below.

SUMMARY OF THE INVENTION

This invention concerns a method of forming a homogenous product from (1) a benzotriazole and (2) a 2,5-dihydrocarbyldithio-1,3,4-thiadiazole having the formula

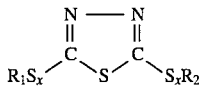

wherein $R_1$ and $R_2$ are independently $R_3S$ or H, $R_3$ is a hydrocarbyl group having from 1 to 16 carbon atoms, provided at least one of $R_1$ and $R_2$ is not hydrogen, x is an integer from 0–3, and wherein the benzotriazole is normally incompatible with said thiadiazole at a temperature of 25° C., which comprises heating at a temperature in the range of 50° to 150° C. the benzotriazole with an amount of the thiadiazole sufficient to form said homogeneous product.

This invention also relates to a method of improving the copper corrosion resistance of a lubricating oil, particularly a gear oil, by adding the homogeneous product described above to said oil. Other embodiments of this invention include (1) a lubricating composition comprising a major amount of a lubricating base oil and a minor amount of the homogeneous product described above, and (2) a concentrate containing the homogeneous product.

DETAILED DESCRIPTION OF THE INVENTION

This invention describes an innovative method of introducing a solid copper corrosive inhibitor such as a benzotriazole into a lubricating composition. More specifically, this invention concerns forming a homogeneous product from a mixture of benzotriazole and a thiadiazole that is normally incompatible when admixed at 25° C.

The benzotriazole used in this invention may be substituted or unsubstituted. Examples of suitable compounds are benzotriazole and the tolyltriazoles, ethylbenzotriazoles, hexylbenzotriazoles, octylbenzotriazoles, phenylbenzotriazoles, and substituted benzotriazoles wherein the substituents may be, for example, hydroxy, alkoxy, halo, nitro, carboxy, or carbalkoxy. Preferred are benzotriazole and the alkylbenzotriazoles in which the alkyl group contains about 1 to 20, especially 1 to 8, carbon atoms. Benzotriazole and tolyltriazole are particularly preferred, with tolyltriazole being most preferred. Benzotriazole and tolytriazole are available under the trade designation Cobratec 99 and Cobratec TT-100, respectively, from Sherwin-Williams Chemical Company.

The thiadiazole used in this invention is a thiadiazole of the formula

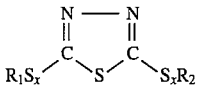

where $R_1$ and $R_2$ are hydrogen or $R_3S$, $R_3$ is a hydrocarbyl group containing from 1 to 16, preferably from 1–10, carbon atoms, and x is an integer from 0–3. The hydrocarbyl groups include aliphatic (alkyl or alkenyl) and alicyclic groups which may be substituted with hydroxy, amino, nitro, and the like. Preferably, however, the hydrocarbyl group is alkyl, with nonyl being particularly preferred. The most preferred thiadiazole is 2,5 -bis (nonyl dithio) -1,3,4, thiadiazole (wherein $R_1$ and $R_2$ are both $R_3$ S, $R_3$ is nonyl, and x=1), which is available from Amoco Chemicals Corporation under the trade designation Amoco-158.

The relative amounts of benzotriazole and thiadiazole used in this invention are not critical provided that the thiadiazole is present in an amount sufficient to solubilize the benzotriazole and form a homogeneous product. While the precise amount of thiadiazole present in the product can vary broadly, generally greater than 50 wt. %, preferably greater than 40 wt %, thiadiazole will be present to ensure the product remains homogeneous during storage at ambient conditions. Generally, from 1 to 40 wt % of the benzotrizole and from 60 to 99 wt % of the thiadiazole are used in this invention.

While the benefits of this invention are applicable to a wide variety of lubricants, this invention is particularly suitable to power transmission fluids such as automatic transmission fluids, gear oils, hydraulic fluids, heavy duty hydraulic fluids, industrial oil, power steering fluids, pump oils, tractor fluids, universal tractor fluids, and the like. These power transmitting fluids can be formulated with a variety of performance additives and in a variety of lubricating base oils.

Suitable lubricating base oils include those derived from natural lubricating oils, synthetic lubricating oils, and mixtures thereof. In general, both the natural and synthetic lubricating oil will each have a kinematic viscosity ranging from about 1 to about 40 mm2/s at 100° C. Natural lubricating oils include animal oils, vegetable oils (e.g., castor oil and lard oil), petroleum oils, mineral oils, and oils derived from coal or shale. The preferred natural lubricating oil is mineral oil.

Synthetic lubricating oils useful in this invention include polyisobutylene, polybutenes, hydrogenated polydecenes, polypropylene glycol, polyethylene glycol, trimethylol propane esters, neopentyl and pentaerythritol ester, di(2-ethyl hexyl) sebacate, di(2-ethyl hexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, and the like.

Performance additives that can be used in this invention include antioxidants, dispersants, antiwear agents, detergents, extreme pressure agents, other corrosion inhibitors, antifoamants, demulsifiers, dyes, metal deactivators, pour point depressants, and the like. A discussion of such additives may be found in, for example, "Lubricant Additives" by C. V. Smalheer and R. Kennedy Smith, 1967, pp. 1-11 and in U.S. Pat. No. 4,105,571.

This invention also includes an additive concentrate comprising the homogeneous product of the benzotriazole and the thiadiazole described above. A solvent or diluent oil may also be present. Such a concentrate is particularly useful when conventional amounts (e.g. 1 to 10 wt. %) are added to a lubricating oil.

This invention and its advantages will be better understood by referring to the example shown below.

EXAMPLE

Solid Cobratec TT-100 (tolyltriazole) was added to liquid Amoco -158 (2,5 -bis (nonyldithio)-1,3,4-thiadiazole) at room temperature (25° C.) in the proportions shown in Table 1 below. The resulting two-phase mixture was heated to about 65° C. and stirred until the solid was completely dissolved. The homogeneous liquid solution was then cooled to 25° C. and the appearance monitored periodically. Table 1 below summarizes the results of the visual observations made.

TABLE 1

| Run No. | 1 | 2 | 3 |
|---|---|---|---|
| TT-100, wt % | 27.3 | 50 | 60 |
| Amoco-158, wt % | 72.7 | 50 | 40 |
| Blend T, °C. | 65 | 65 | 65 |
| Initial appearance at 65° C. | clear | clear | clear |
| Appearance after 1 hr of cooling | clear | clear | clear |
| Final appearance/duration of 25° C. | clear/2 days | hard solid/4 days | hard solid/4 days |

The data in Table 1 show that a binary mixture of TT-100 and Amoco-158 (27/73 wt. %) was completely miscible during storage at 25° C. for 2 days. At higher amounts of TT-100 (50–60 wt. %), the solid was also miscible in Amoco-158 at 65° C. and after 1 hour of cooling. However, the mixture solidified after storage at 25° C. for 4 days.

What is claimed is:

1. A method for forming a homogeneous product from a benzotriazole and a 2,5-dihydrocarbyldithio-1,3,4, -thiadiazole having the formula

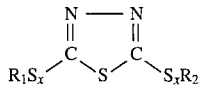

where $R_1$ and $R_2$ are independently $R_3S$ or H, $R_3$ is a hydrocarbyl group having from 1 to 16 carbon atoms, provided at least one of $R_1$ and $R_2$ is not hydrogen, x is an integer from 0 to 3, and wherein the benzotriazole is normally incompatible with said thiadiazole at a temperature of 25° C., which comprises heating at a temperature in the range of from 50° to 150° C. the benzotriazole with an amount of the thiadiazole sufficient to form said homogeneous product.

2. The method of claim 1 where the benzotriazole is benzotriazole, tolyltriazole, or mixtures thereof.

3. The method of claim 2 wherein both $R_1$ and $R_2$ are $R_3S$ and $R_3$ is a hydrocarbyl group containing from 1 to 10 carbon atoms.

4. The method of claim 1 wherein $R_3$ is a hydrocarbyl group containing from 1 to 10 carbon atoms.

5. The method of claim 1 wherein from 1 to 40 wt. % of the benzotriazole and from 60 to 99 wt. % of the thiadiazole are present in the mixture.

6. A method of improving the copper corrosion resistance of a lubricating oil which comprises adding the homogeneous product formed in claim 1 to said oil.

7. A homogeneous product formed by the method of claim 1.

8. A lubricating oil comprising a major amount of lubricating base oil and a minor amount of the homogeneous product formed in claim 1.

9. An additive concentrate comprising the homogeneous product formed in claim 1.

10. The concentrate of claim 9 herein the benzotriazole is tolyltriazole and the thiadiazole is 2,5-bis (nonyl dithio)-1, 3,4-thiadiazole.

* * * * *